US010774641B2

(12) United States Patent
Hussey et al.

(10) Patent No.: US 10,774,641 B2
(45) Date of Patent: Sep. 15, 2020

(54) LOAD SUPPORT DRUM WITH RESILIENT CORE MEMBER

(71) Applicant: MICON, Glassport, PA (US)

(72) Inventors: David A. Hussey, Pittsburgh, PA (US); George A. Watson, Prosperity, PA (US)

(73) Assignee: Micon, Glassport, PA (US)

( * ) Notice: Subject to any disclaimer, the term of this patent is extended or adjusted under 35 U.S.C. 154(b) by 47 days.

(21) Appl. No.: 16/079,675

(22) PCT Filed: Feb. 23, 2017

(86) PCT No.: PCT/US2017/019079
§ 371 (c)(1),
(2) Date: Aug. 24, 2018

(87) PCT Pub. No.: WO2017/147262
PCT Pub. Date: Aug. 31, 2017

(65) Prior Publication Data

US 2019/0024508 A1 Jan. 24, 2019

Related U.S. Application Data

(60) Provisional application No. 62/299,396, filed on Feb. 24, 2016.

(51) Int. Cl.

| | |
|---|---|
| ***E21D 15/18*** | (2006.01) |
| *E21D 15/00* | (2006.01) |
| *E21D 15/30* | (2006.01) |

(52) U.S. Cl.
CPC ..... *E21D 15/18* (2013.01); *E21D 15/00* (2013.01); *E21D 15/303* (2013.01)

(58) Field of Classification Search
CPC ..... E21D 15/18; E21D 15/303; E21D 15/16; E21D 15/14; E21D 15/28; E21D 15/42; E21D 15/502; E21D 15/00
(Continued)

(56) References Cited

U.S. PATENT DOCUMENTS 1,895,053 A * 1/1933 Staley ..... E21D 15/18 248/354.2
3,949,877 A * 4/1976 Santoni ..... B65D 7/02 206/519
(Continued)

OTHER PUBLICATIONS

International Search Report dated May 16, 2017 in International Application No. PCT/US2017/19079 filed Feb. 23, 2017.

*Primary Examiner* — Nkeisha Smith
(74) *Attorney, Agent, or Firm* — Spilman Thomas & Battle PLLC; William P. Smith

(57) ABSTRACT

A load bearing support includes a cylindrical drum. A top portion, a bottom portion, a tapered cylindrical sidewall extends between the top and bottom portions. A core member extends between the top and bottom portions, and a load-bearing material is disposed between the sidewall and the core member. An opening extends through the top portion of the drum to receive load-bearing material. Each of the top portion and the bottom portions has a reinforcing chime. The core member includes a lateral transfer zone defined at one or more points along a vertical axis of the core member. The lateral transfer zone distributes an axial load on the drum to the cylindrical sidewall. The cylindrical sidewall provides a radial expansion area for compression of the core member and the load-bearing material.

14 Claims, 5 Drawing Sheets

(58) Field of Classification Search
USPC ..... 248/351; 405/288, 289
See application file for complete search history.

(56) References Cited

U.S. PATENT DOCUMENTS 4,281,487 A * 8/1981 Koller ..... F16F 7/125 248/351
4,534,531 A * 8/1985 Brown ..... E21D 15/02 248/351
4,712,947 A 12/1987 Thom
4,909,393 A * 3/1990 Palisin, Jr. ..... B21D 51/2646 206/515
4,915,339 A * 4/1990 Halbich ..... E21D 15/02 248/351
5,318,387 A * 6/1994 Pienaar ..... E21D 15/55 248/544
5,868,527 A * 2/1999 King ..... E21D 15/00 248/351
6,558,085 B1 * 5/2003 Hall ..... E21D 15/005 405/288
6,910,834 B2 * 6/2005 Harbaugh ..... E21D 15/02 248/351
7,503,731 B2 * 3/2009 Seegmiller ..... E21D 15/22 405/288
8,801,338 B2 * 8/2014 Hussey ..... E21D 15/48 405/289
2006/0133899 A1 * 6/2006 Seegmiller ..... E21D 15/22 405/290
2011/0262231 A1 * 10/2011 Hussey ..... E21D 15/483 405/289
2012/0269585 A1 10/2012 Faulkner
2014/0348596 A1 * 11/2014 Hussey ..... E21D 15/502 405/288
2015/0147122 A1 * 5/2015 Faulkner ..... E21D 15/18 405/288
2015/0184512 A1 * 7/2015 Shook ..... E21D 15/18 405/289
2016/0061032 A1 * 3/2016 Shook ..... E21D 15/48 405/288
2019/0203597 A1 * 7/2019 Abel ..... E21D 15/303

* cited by examiner

LOAD SUPPORT DRUM WITH RESILIENT CORE MEMBER

CROSS-REFERENCE TO RELATED APPLICATION

This application claims the benefit of and priority to U.S. Provisional Patent Application No. 62/299,396 entitled "LOAD SUPPORT DRUM WITH RESILIENT CORE MEMBER" filed on Feb. 24, 2016, which is hereby incorporated by reference in its entirety.

BACKGROUND OF THE INVENTION

The application generally relates to load bearing supports. The application relates more specifically to load bearing columns constructed of multiple stacked drums with a resilient core member surrounded by filler material.

Various devices disclosed in the prior art are designed and used to provide support to a mine roof. Underground mining results in removal of material from the interior of a mine, thereby leaving unsupported passageways of various sizes within the mine. The lack of support in such passageways may cause mine roof buckling and/or collapse. Thus, it has been desirable to provide support to mine roofs to prevent, delay, or control collapse thereof.

In both underground mining and areas of seismic activity, supports must be engineered to withstand enormous forces propagating through the earth. Building and bridge structures may include modified foundations designed to isolate the superstructure from major ground motion during an earthquake. Such supports for building structures are intended to avoid the transmission of high seismic forces.

Bridges and building structures which are located in an earthquake zone are capable of being damaged or destroyed by seismic forces. In general bridge structures may be constructed with bearings between the bridge's deck or superstructure and the bridge supporting columns to permit relative movement between the two. It is also known to provide damping for the movement upon these bearings of superstructure relative to supports, however the permitted relative movement is not large and furthermore it is not always preferred to attempt to hold a superstructure in a position around a neutral point with respect to the supports.

In underground mining applications, supports of aerated concrete in a hollow tube have been used to permit a support to yield axially in a controlled manner that prevents sudden collapse of an underground mine roof. Such supports yield axially as the aerated concrete within the product is crushed and maintains support of a load as it yields.

An oak wood post having a length of 6.5 feet and a diameter of 6 inches will have a slenderness (height to width) ratio of 26. Such a post will have a maximum axial load capacity of about 16,000 lbs. For a post formed from spruce, the maximum safe axial load handling capability for a post that is 6.5 feet in length and 6 inches in diameter is about 13,600 pounds. In addition, when a wood post yields by kneeling or buckling, such yielding will result in catastrophic failure of the post in which the post can no longer support the load.

Because of the obvious problem associated with such catastrophic failure of posts, various mine props have been developed in the art for supporting the roof of an underground mine. Such mine props have included, various configurations of wood beams encased in metal housings, and complex hydraulically controlled prop devices. Such props, however, do not allow for controlled axial yielding while preventing sideways buckling or kneeling in a simple, lightweight prop that can be hand carried by a user.

U.S. Pat. No. 5,308,196 to Frederick discloses a prior art mine roof support comprising a container that is placed between the mine roof and the mine floor and filled with a load-bearing material.

In instances where a support is compressed, whether due to seismic forces or geological forces, the support generally is incapable of rebounding when the load is reduced or removed. What is needed is a support that can compress under extreme loads and rebound to maintain contact with the load, and which satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

BRIEF SUMMARY OF THE INVENTION

In one embodiment a load bearing support is disclosed. The load bearing support includes a cylindrical drum, comprising a top portion, a bottom portion, a tapered cylindrical sidewall extending between said top portion and said bottom portion, at least one core member extending between the top portion and the bottom portion, and a load-bearing material disposed between the sidewall and the core member ; an opening extending through the top portion of the cylindrical drum for receiving the load-bearing material therethrough; and each of the top portions and the bottom portions comprising a reinforcing chime; the at least one core member comprising a lateral transfer zone defined at one or more points along a vertical axis of the core member, the lateral transfer zone arranged to distribute a portion of an axial load on the drum to the cylindrical sidewall, the cylindrical sidewall providing a radial expansion area for compression of the at least one core member and the load-bearing material.

Another embodiment discloses a method of supporting a load comprising: providing a cylindrical drum having a top portion, a bottom portion, a tapered cylindrical sidewall extending between said top portion and said bottom portion, at least one core member extending between the top portion and the bottom portion, and a load-bearing material disposed between the sidewall and the core member; removing at least a portion of the at least one core member to define a lateral transfer zone along a vertical axis of the core member, applying a load on the cylindrical drum in an axial direction compressing the core member under the applied load to yield partially at the defined lateral transfer zone; distributing the axial load laterally through the core member as the core member yields, expanding the tapered cylindrical sidewall as axial compression of the core member and the load-bearing as the applied load increases; and in response to a reduction or axial displacement in the applied load after compression, extending the core member axially to retain a support contact between the drum and the load by rebounding in the core member axial direction.

The disclosure relates to a mine roof support including at least one core member or segments, e.g., a wood post or log—inserted vertically in a cladding or continuous metal cylinder, with the direction of wood grain coinciding with the axis of the cylinder or drum. The cylinder is preferably a conventional 55 gallon drum with cylinder walls having chimes or hoop stiffeners, or a frusto-conical drum with tapering sidewalls. After the core segments are inserted into the drum or drums (drums may be stacked to achieve a desired height for the roof support), flowable filler such as a cementitious material, e.g., foam cement is poured into the drums to occupy the gaps between the core segments so as to encapsulate the timber segments within the drum cylinder. Dry, flowable aggregate or sand may be used as gap filler instead. The support is placed vertically between a mine bottom and a mine roof to provide support in mine entries to prevent or control the collapse of a roof in a mine entry. The metal cladding in the form of one or more stacked drums provides an elastic expansion that allows the assembled support to partially compress—e.g., 12 inches (30.5 cm) of roof sag—and yield gradually, allowing the internal contents of the drum cladding to expand laterally under roof loading before the roof collapses. The roof support rebounds partially upon removal of the load to maintain contact with the roof surface if the roof moves away from the support.

Certain advantages of the embodiments described herein include a controlled yielding of the drum support without releasing the load, up to at least 200 tons and to as much as 300 tons.

Another advantage is the ability to use the disclosed drum support in various applications including underground mining, bridge construction and repair, and seismic supports for buildings and other structures, as permanent or temporary load supports for very large loads, using inexpensive materials and assembly methods.

Still another advantage is the ability to customize the load bearing characteristics by designing the core members to yield according to weight and desired load deflection profile, as well as rebounding effect of the core members, by inserting slits or drill patterns in predetermined configurations along the core member axis or axes.

Yet another advantage is the ability to design a matrix of bound components working in harmony to provide support for massive loads.

Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Commonly owned U.S. patent application Ser. No. 14/456, 497 having a filing date of Aug. 11, 2014, entitled "NESTED MINE ROOF SUPPORTS"; U.S. Pat. No. 8,801, 338 issued Aug. 12, 2014, entitled "NESTED MINE ROOF SUPPORTS" and U.S. Pat. No. 8,851,804 issued Oct. 7, 2014, entitled "PUMPABLE SUPPORT WITH CLADDING", disclose various mine roof supports and methods, and are hereby incorporated by reference in their entirety.

The present invention includes a mine roof support set comprising a plurality of containers having a longitudinal axis and adapted to be placed in a passageway in a mine, with the longitudinal axis extending between the mine roof and the mine floor, and filled with a load-bearing material.

Figure 1:
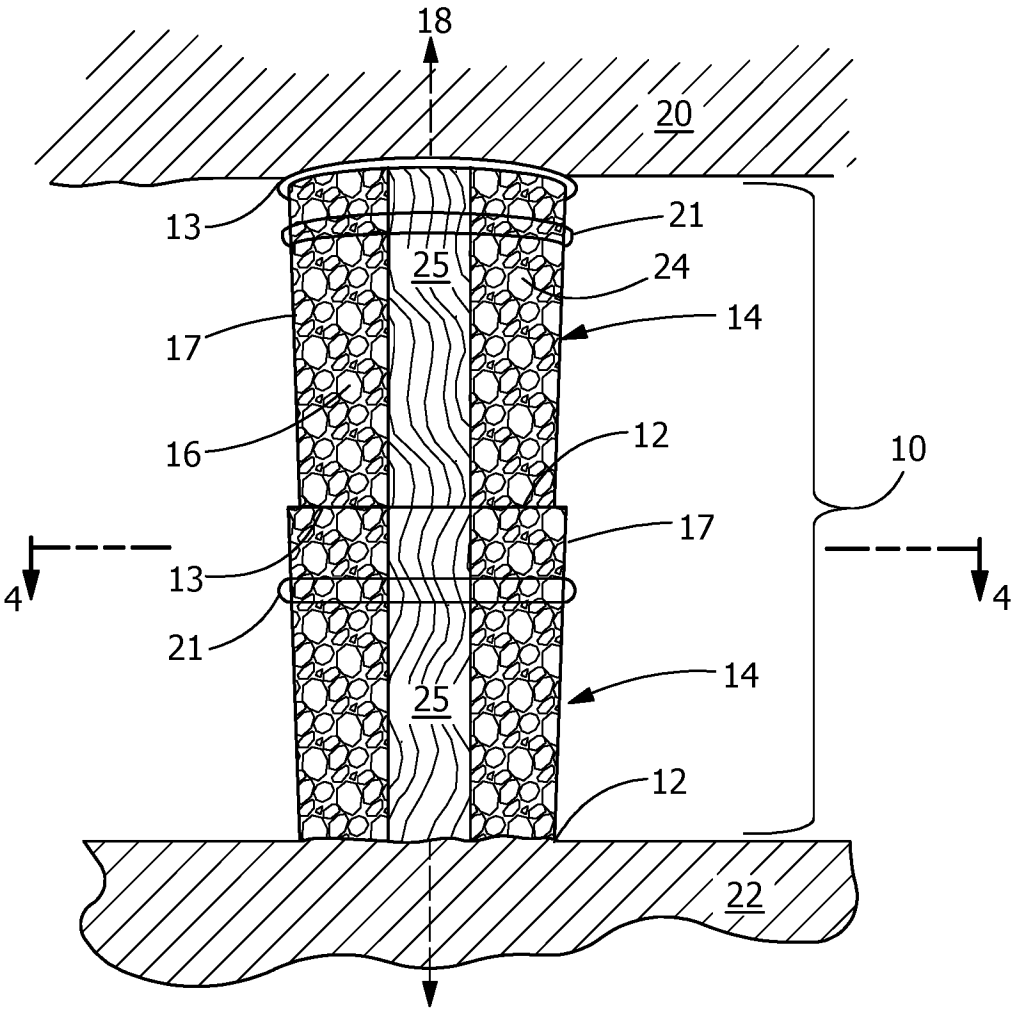
FIG. 1 shows a cross-sectional elevational view of an exemplary embodiment of a roof support of the present invention.

FIG. 1 shows a cross-sectional elevational view of an exemplary embodiment of a roof support 10. Roof support 10 includes two drums or containers 14 has a bottom end 12, a top end 13, and a sidewall 17 extending from the bottom end 12 to the top end 13. The bottom end 12 and/or the top end 13 may be substantially open or may be covered by an end cap (not shown). The sidewall 17 defines an internal cavity 16 of the hollow drum 14. In the embodiment shown in FIG. 1, roof support 10 is made up of two stacked drums 14 to achieve the desired proximity to the roof surface 20. Roof support 10 may be made of a single drum 14 or multiple stacked drums as needed to obtain the height of the mine roof 20 from the mine bottom 22. In addition, a yield ring, beam, footing or wedges may be inserted on top of the roof support 10 to take up any gap between the roof support 10 and the mine roof surface 20, such that the weight of the mine roof is transferred to the roof support 10. Other shims may include pumpable containment structures (e.g., bags) or a pumpable telescoping structure such as disclosed in U.S. Pat. No. 6,394,707, incorporated herein by reference.

Figure 2:
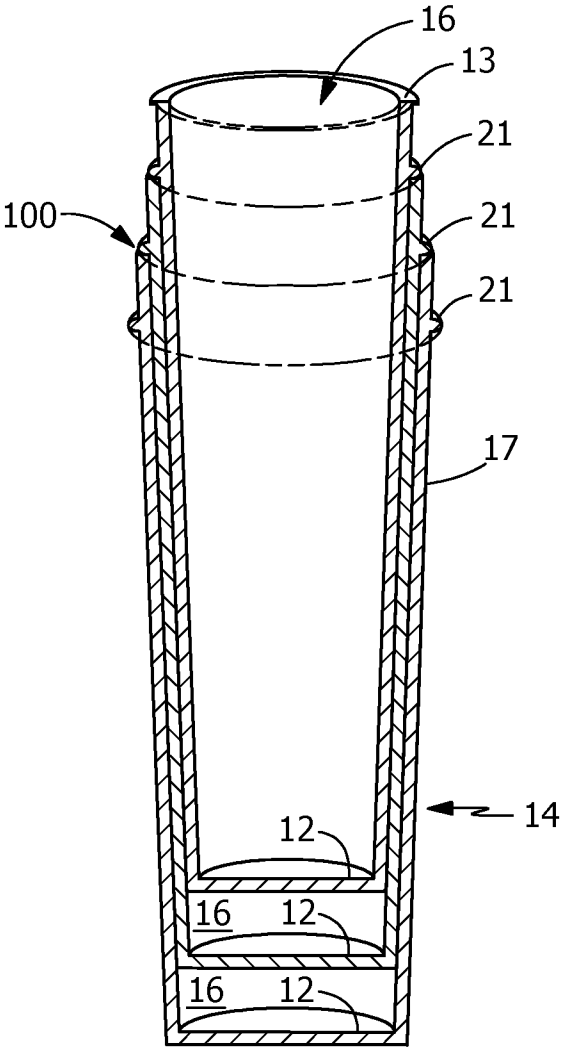
FIG. 2 shows a perspective view of a mine roof support set according to the present invention showing a plurality of empty nested drums with tapered sidewalls.

Drums 14 may have a frusto-conical shape with slightly tapered outer walls to facilitate nesting for transportation and to allow a margin or gap around the interior of the nested containers. Drums may also include a reinforcing chime or ring 21, located at one or more locations about the periphery of the sidewall 17. FIG. 2 shows a mine roof support set according to the present invention showing a plurality of empty nested drums with tapered sidewalls 17. Alternately, sidewalls may have substantially straight sidewalls 17 such as conventional 55 gallon drums.

In use, the container is placed with its longitudinal axis 18 extending between a mine roof 20 and a mine floor 22 such that the bottom end 12 of the container 10 is in contact with the mine floor 22. A core member or members 25 is disposed vertically inside the cavity 16 at the approximate center of drum coaxial with axis 18, or if multiple core members are used, parallel with axis 18. The cavity 16 is then filled with a load-bearing material 24 surrounding core member or members 25. In one exemplary embodiment core member 25 may be composed of wood sections of circular, square or rectangular cross-section. Preferably the wood grain is aligned vertically, i.e., parallel with axis 18, to provide resiliency and rebounding properties as will be discussed in greater detail below. Alternative materials for the core members may be used, such as steel or other high-strength post material. Various wood species may be used depending on the loading properties, cost and availability. E.g., oak and cherry wood exhibit greater hardness and may be capable of higher load capacity, whereas pine may be a less expensive wood with lower load capacity than hardwood species. Each support may be customized accordingly, based on desired load capacity.

In one exemplary embodiment, the load-bearing material 24 may be particulate and flowable which provides efficient filling of the cavity 16. By using particulate and flowable materials, a maximum amount of space is filled in the cavity 16, unlike if larger rocks or objects were to be used. Exemplary and non-limiting load-bearing materials 24 include pea gravel, sand, foamed cement (FOAMCRETE), concrete, polyurethane, coal from a mine entry, mine slack (i.e., wash plant refuse), and crushed mine tailings (e.g., discarded excavated mine material).

Although the container 10 shown in FIG. 1 preferably has a circular cross-section, the container of the present invention may have any cross-sectional shape including, but not limited to, circular, oval, square, rectangular, and polygonal. It may be made from any suitable material including, but not limited to, metal. It may include chimes or other cladding or reinforcing features to allow it to be compressible or improve its load-bearing capability when placed in the mine entry or improve its stiffness when being transported including, but not limited to, ribbing. The ribbing of the container 10 may include, but is not limited to, a continuous helical rib, a plurality of discontinuous ribs or a plurality of spaced apart ribs. Alternatively, the container sidewall 17 may have a substantially smooth surface, without ribs, corrugation, or the like, although certain dents and other imperfections may be present which do not affect operation of the present invention.

Figure 3:
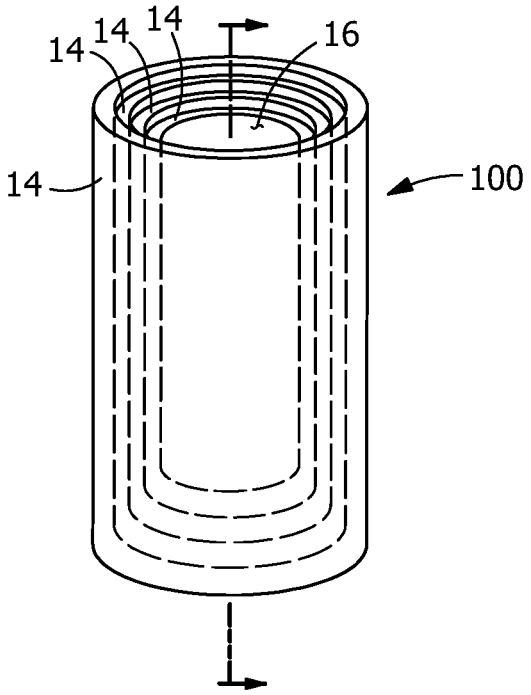
FIG. 3 shows an alternate embodiment of a mine roof support set having straight sidewalls.

FIG. 2 shows a perspective view of one embodiment of a mine roof support set 100 according to the present invention. As can be seen in FIG. 2, three drums 14 are nested partially inside another, with rings 21 supported on the top surface or edge 13 of the adjacent drum for ease of handling, such as in transportation to a mine site. The tapered sidewall 17 allows the remainder of the drum 14 to slip into the lower portion of the adjacent drum. In an alternate embodiment shown in FIG. 3, the outside dimension of each container may be progressively smaller than the next, with straight sidewalls 17. As shown in FIG. 3, containers 14 have progressively smaller outside diameters. Four containers 10 are shown in FIG. 3, but this is not meant to be limiting. The quantity of containers 10 nested in a set 100 may be varied depending on the underground roof conditions and related logistics.

In one embodiment, the containers 10 all possess the same or similar sidewall 17 thickness. In a preferred embodiment the sidewall thickness may be 1.2 millimeters (mm), to provide a desired elasticity under load for containing the filler material 24 and core member 25. Drums 14 may all have the same height or the drums 14 may have decreasing outer dimensions taken in the direction from the outermost container 10 to the innermost container 10 or some other arrangement, including random heights, provided that the containers 10 nest in each other.

Figure 4:
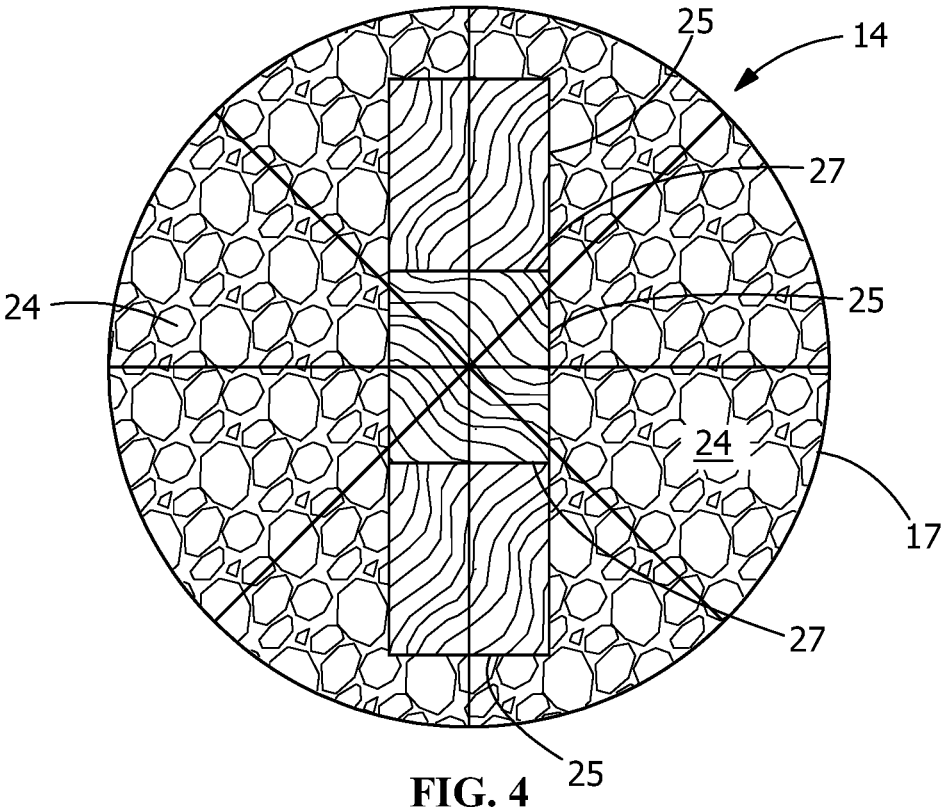
FIG. 4 shows a cross-sectional plan view of a support drum with core members and filler material inside.

Referring next to FIG. 4, a cross-sectional view taken along the lines 4-4 in FIG. 1 shows the filler material 24 and core members 25 disposed within the drum 14. In the example shown in FIG. 4, the inside diameter (I.D.) of drum 14 is 22.5 inches (in.), and the wooden core members 25 are 6 in.×5 in. posts cut to the length of the drum 14 before loading and deformation occurs, i.e., about 36 in. As shown, three core members 25*a*, 25*c*, are positioned in a row with both end members abutting a vertical surface 27 of the middle core member 25*b*. Filler material 24, e.g., gravel, surrounds the core members 25 and fills the cavity 16 between the sidewall 17 and core members 25. Air gaps occurring naturally between the compacted gravel allows the drum 14 to slowly compress under load, with core members providing additional reinforcing strength that increases the load bearing limit of the support 10.

Figure 8:
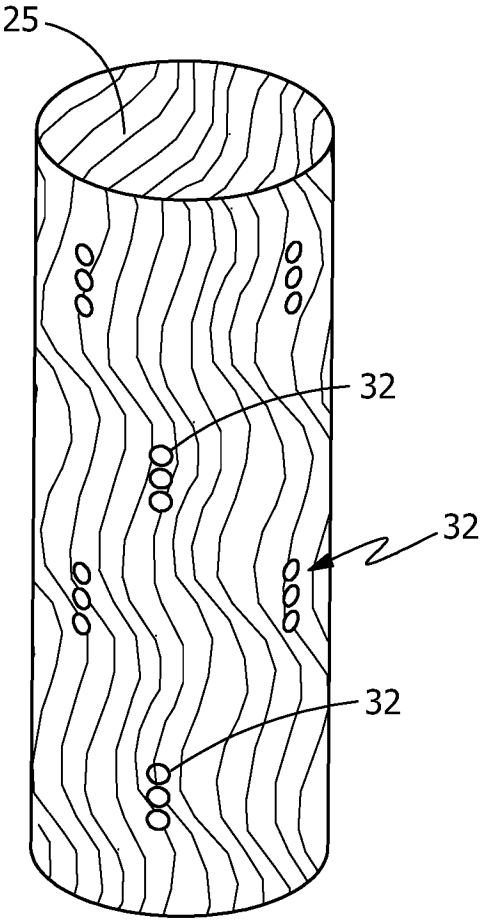
FIG. 8 shows an alternate embodiment of a core member having apertures.

Referring next to FIGS. 5-8, core members 25 may include control zones defined by slits 30 or apertures 32 inserted in the respective core member 25. Slits 30 are made by placing a pair of saw cuts at acute angles on opposing sides of a core member 25. Opposing slits may penetrate a portion of the radius or thickness of the core member 25 without intersecting the opposite slit, i.e., so that at least a portion of the core member is not cut completely through. The depth of the opposing slits 30 may be more or less depending on how quickly lateral load transfer within the support is desired, and the degree of rebound capability that is desired when the load is removed from the support 10. Similarly, apertures 32 may be drilled in various patterns, as illustrated in FIG. 8. FIG. 8 shows three sets of apertures at right angles, each set of apertures comprising three bore holes parallel and tangent to one another. More or less bore holes, and different angles may be used to customize various properties of the support 10, such as failure load limit, distribution of lateral load points on the sidewall, and rebound capability of the core member.

Figure 5:
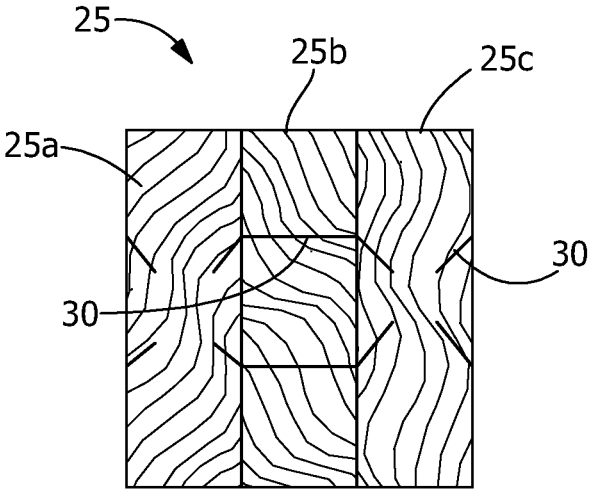
FIG. 5 shows an exemplary core member having three post sections in abutment.
Figure 6:
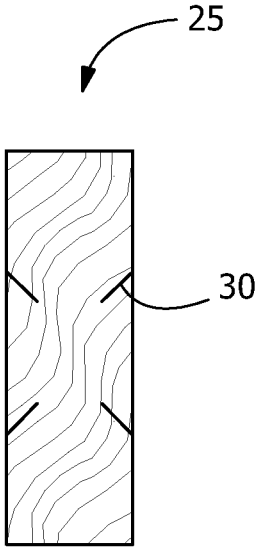
FIG. 6 shows an elevational view of a single post section of a core member.
Figure 7:
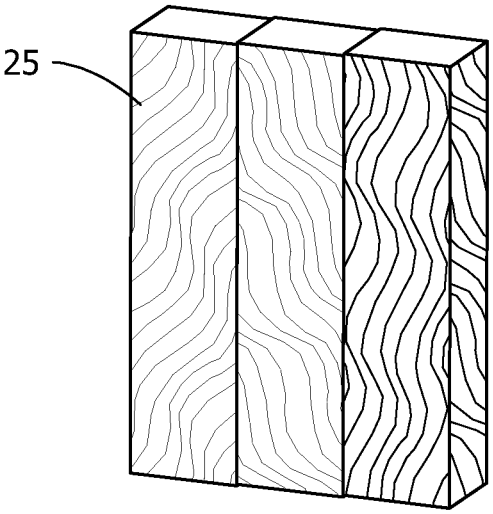
FIG. 7 shows an alternate embodiment of a core member comprised of three post sections without slits.
Figure 10:
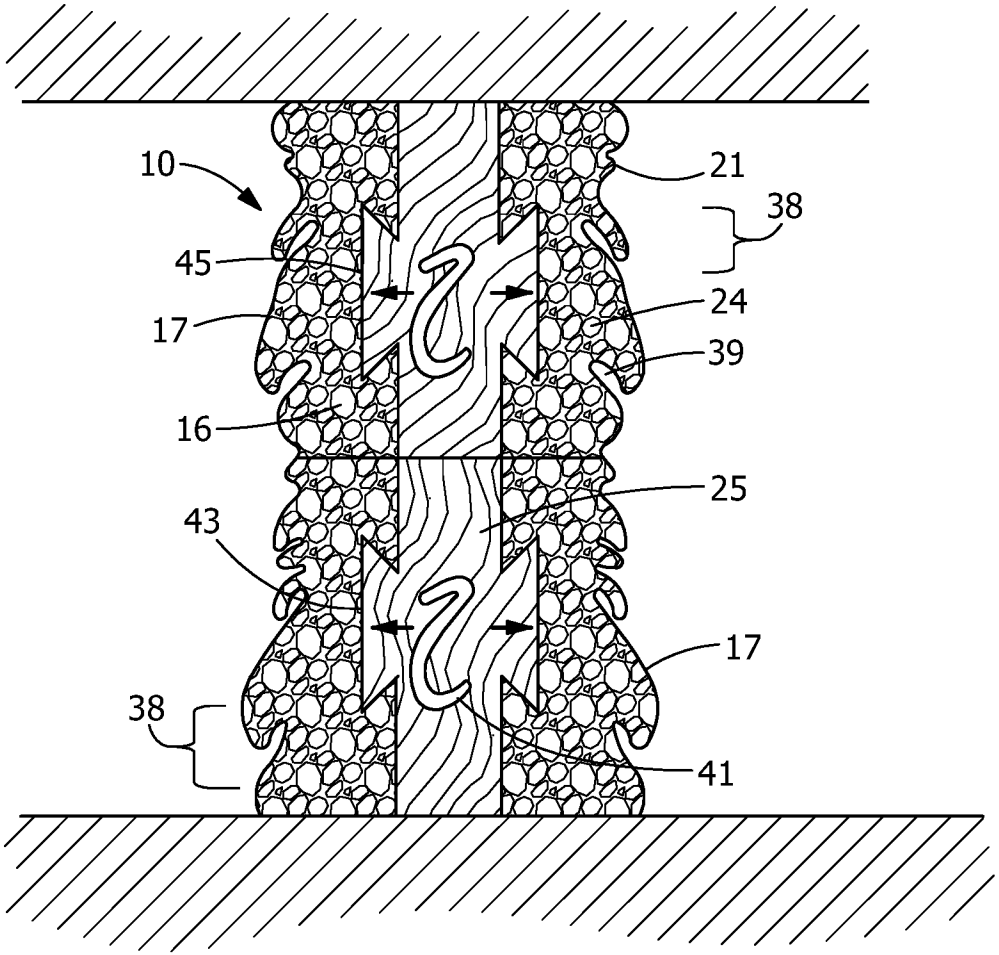
FIG. 10 shows a deformed support after loading.

FIG. 5 shows an elevational view of an exemplary core member 25 having three wooden post segments 25*a*, 25*b* and 25*c*, bound together to form a single core member 25. Each post segment has a pair of slits 30 cut into the post segment on opposing sides. The slits in each pair are angled towards one another, to allow vertical compressive forces coming from the mine roof to be transferred laterally along the sidewall 17 through the filler material 24. As the weight of the earth overburden is applied to the support through the mine roof, or alternately from the mine bottom, the support 10 is gradually compressed and the metal sidewalls 17 of the drums 14 slowly stretch while the vertical load compresses and pulverizes the filler material 24 within the drum 14, and at the same time the core members 25*a*-25*c* are compressed and begin to expand laterally in the area of the designated slits 30.

Figure 9:
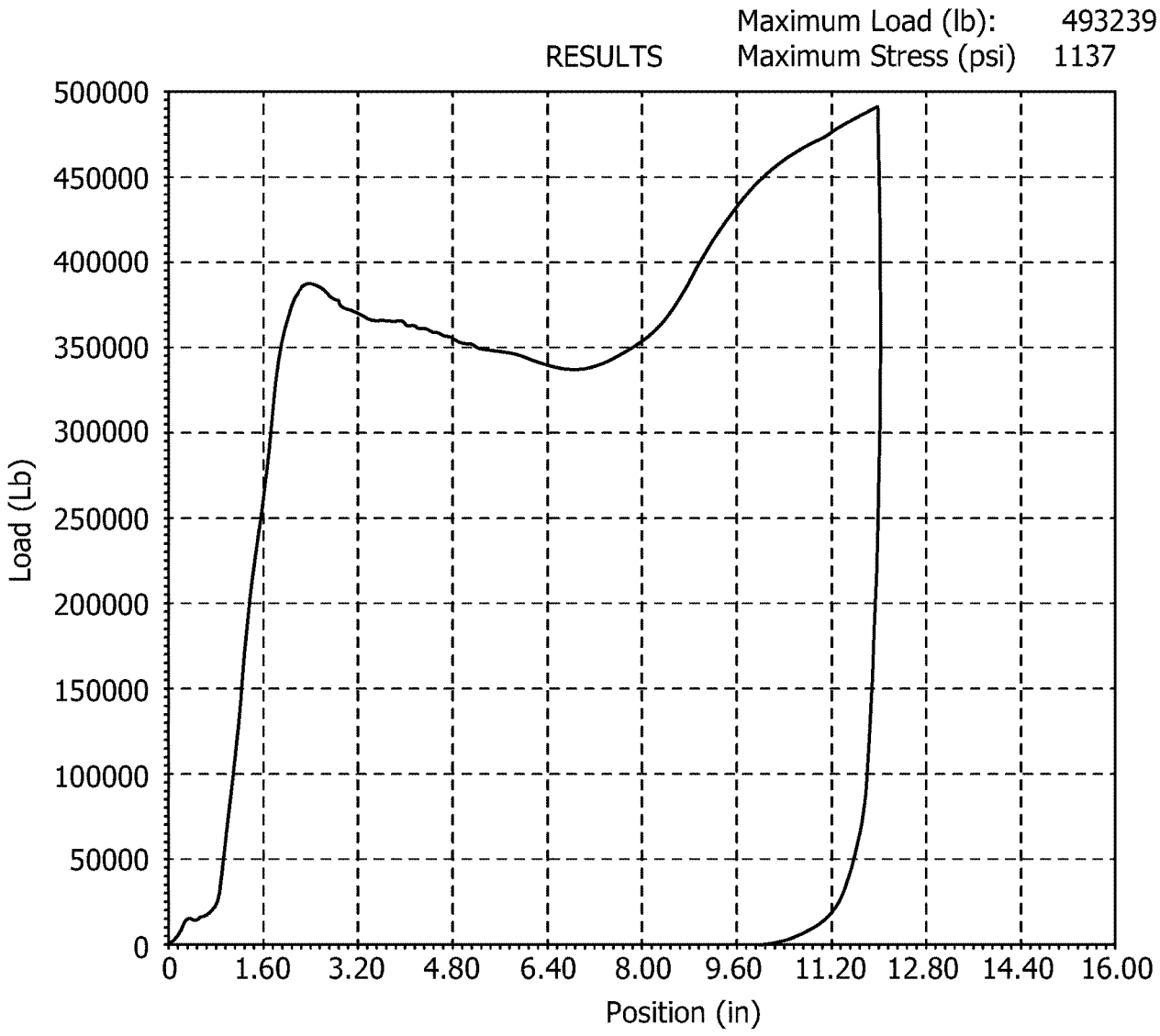
FIG. 9 shows a load profile of a drum support.

A typical load profile of a roof support of the type shown in FIG. 4 is shown in FIG. 9. As the load on the support drum increases from 0 to about 390 kips, the drum support compresses by about 2 in. (5.08 cm). The load remains relatively constant, between 390 and 440 kips until the height of the drum support is reduced to about 9.6 in. (24.4 cm), then increases to about 493 kips until the maximum displacement of 12 in. (30.5 cm) occurs. Additional loading may be possible before failure, as the test results did not continue to increase the load above 493 kips. At 493 kips, the load was gradually removed, and the drum rebounded about 2 in. (5.08 cm) from the height at the maximum displacement.

Without being bound by theory, the rebound results as a property of the matrix formed between the metal sidewall 17 of the drum 14, which has an elastic property under such great force, the filler material 24, in this instance gravel that is partially pulverized to displace air pockets within the drum 14, and the core member, which folds between the slits or drill holes as the yield sections are laterally displaced within the drum 14. The core members 25 provide controlled deformation that prevents the release of the load and allows the metal sidewalls 17, typically a sheet metal skin of between 1 mm to 2 mm thickness, to fold over itself slowly. Referring to FIG. 9, the folding of the steel sidewalls occurs in peripheral bands 38 adjacent to the lateral transfer zone defined by the slits 30 or drill holes 32, and as the sidewall folds over itself the lateral strength is increased due to the additional sidewall thickness that is created by the three-ply fold 39. As shown in FIG. 8, as the support 10 yields core members 25 deform in an S-shaped section 41 and the slits 30 form a keystone-like section 43 displaced laterally of the S-shape section, as indicated by arrows 45. When the load is reduced or released, e.g., where the mine roof heaves or buckles due to mine conditions, or in the case of a bridge structure, a shifting of the load displaces a portion of a horizontal beam, the core member and filler material, and possibly the sidewalls, rebound to extend partially towards their original height prior to loading. The rebound property of the support may be further enhanced or controlled by binding the matrix of filler, sidewall and core member with a settable material such as polyurethane, adhesives or grout.

It should be noted that while the roof support 10 has been described in the context of an underground mine roof support, the roof support may be used to reinforce a bridge or building structure, e.g., in a seismic zone or as a temporary or permanent column support during construction, replacement or maintenance of the structure.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the load support drum with resilient core member, as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A load bearing support comprising:

at least two cylindrical drums, each drum comprising a top portion, a bottom portion, a tapered cylindrical sidewall extending between said top portion and said bottom portion, at least one core member extending between the top portion and the bottom portion, and a load-bearing material disposed between the sidewall and the core member;

an opening extending through the top portion of the cylindrical drum for receiving the load-bearing material therethrough; and each of the top portions and the bottom portions comprising a reinforcing member;

the at least one core member comprising a lateral transfer zone defined at one or more points along a vertical axis of the core member, the lateral transfer zone arranged to distribute a portion of an axial load on the drum to the cylindrical sidewall, the cylindrical sidewall providing a radial expansion area for compression of the at least one core member and the load-bearing material.

2. The load bearing support of claim 1, wherein the lateral transfer of each drum are defined by features inserted in the core member associated with the features.

3. The load bearing support of claim 2, wherein the features comprise slits or apertures.

4. The load bearing support of claim 3, wherein the slits comprise saw cuts disposed at acute angles on opposing sides of the core member.

5. The load bearing support of claim 4, wherein the slits penetrate a portion of a radius or thickness of the core member without intersecting an opposing corresponding slit.

6. The load bearing support of claim 5, wherein a depth of the opposing slits determines a time in which a lateral load transfer occurs.

7. The load bearing support of claim 6, wherein, the depth of the opposing slits determines a desired degree of rebound capability upon removal of the load from the support.

8. The load bearing support of claim 3, wherein the apertures are drilled in a predetermined pattern to determine a time in which a lateral load transfer occurs.

9. The load bearing support of claim 8, wherein the apertures comprise three pairs of apertures disposed at right angles, each set of apertures comprising three parallel bore holes.

10. The load bearing support of claim 9, wherein the apertures comprise three pairs of tangent apertures.

11. The load bearing support of claim 8, wherein the predetermined pattern comprises bore holes, and a relative angle between bore holes varies one or more support properties of the support.

12. The load bearing support of claim 11, wherein the one or more support properties comprises at least one of a failure load limit, a distribution of lateral load points on the sidewall, and a rebound capability of the core member.

13. A method of supporting a load comprising: providing a cylindrical drum having a top portion, a bottom portion, a tapered cylindrical sidewall extending between said top portion and said bottom portion, at least one core member extending between the top portion and the bottom portion, and a load-bearing material disposed between the sidewall and the core member;

removing at least a portion of the at least one core member to define a lateral transfer zone along a vertical axis of the core member;

applying a load on the cylindrical drum in an axial direction;

compressing the core member under the load applied in the axial direction to yield partially at the defined lateral transfer zone;

distributing the load applied in the axial direction laterally through the core member as the core member yields, and expanding the tapered cylindrical sidewall as axial compression of the core member and the load-bearing as the load applied in the axial direction increases.

14. The method of claim 13, further comprising: in response to a reduction or axial displacement in the applied load after compression, extending the core member to remain in contact with the load by rebounding in the axial direction.

* * * * *